US005333400A

United States Patent [19]

Sonerud

[11] Patent Number: 5,333,400

[45] Date of Patent: Aug. 2, 1994

[54] COUPLING OF DRIVE SYSTEMS TO AN ACCESSORY OR AN EXCAVATOR OF THE LIKE

[76] Inventor: John T. Sonerud, Vintervägen 30, S-824 00 Hudiksvall, Sweden

[21] Appl. No.: 809,481

[22] PCT Filed: Jul. 17, 1990

[86] PCT No.: PCT/SE90/00495

§ 371 Date: Jan. 13, 1992

§ 102(e) Date: Jan. 13, 1992

[87] PCT Pub. No.: WO91/01414

PCT Pub. Date: Feb. 7, 1991

[30] Foreign Application Priority Data

Jul. 18, 1989 [SE] Sweden ..... 8902561-3

[51] Int. Cl.[5] ..... B66C 23/00

[52] U.S. Cl. ..... 37/468; 37/403; 37/443; 414/723

[58] Field of Search ..... 37/103, 117.5, DIG. 3, 37/DIG. 12, 234, 361, 362, 468, 403, 443, 903, 336; 285/62, 920; 414/686, 723

[56] References Cited

U.S. PATENT DOCUMENTS

| | | | |
|---|---|---|---|
| 3,243,066 | 3/1966 | Gardner et al. | 414/723 X |
| 3,560,040 | 2/1971 | Funk | 37/DIG. 3 |
| 4,142,642 | 3/1979 | Myers | 414/686 X |
| 4,355,476 | 10/1982 | Engkvist | 37/117.5 |
| 4,938,651 | 7/1990 | Gilmore et al. | 414/723 X |
| 5,108,252 | 4/1992 | Gilmore et al. | 414/723 X |

*Primary Examiner*—Randolph A. Reese
*Assistant Examiner*—J. Russell McBee
*Attorney, Agent, or Firm*—Watson, Cole, Grindle & Watson

[57] ABSTRACT

In order to quickly and easily provide a coupling of a drive fluid to a hydraulic cylinder of an accessory of an excavator, a part articulately connected with a dipper arm and a dipper ladle link of the excavator is also provided with one or more hydraulic couplings of a female type. The accessory to be coupled to the part is provided with the corresponding hydraulic couplings of a male type, so that on connection to the part the accessory after fixing, rotating and locking is also connected to a drive fluid. The hydraulic couplings are kept together by the accessory having been connected to the Joint means of the excavator. When the accessory is disconnected and removed, the hydraulic connections will also be interrupted.

3 Claims, 1 Drawing Sheet

COUPLING OF DRIVE SYSTEMS TO AN ACCESSORY OR AN EXCAVATOR OF THE LIKE

BACKGROUND OF THE INVENTION

1. Field of the Invention

The present invention relates to the coupling of drive systems to an accessory of an excavator or the like, wherein for example hydraulic lines are automatically interconnected on coupling of the accessory to the operating part of the excavator, or to the swivelling joint, rotator or the like of the dipper arm.

2. Prior art

In operating an excavator it has become increasingly common to use hydraulic quick couplings to couple and connect, from the driver's cab, hydraulically operated accessories with one or more hydraulic cylinders used for digging.

SUMMARY OF THE INVENTION

In order to quickly and easily provide a coupling and connection of a drive fluid to an accessory on coupling cf the accessory to an excavator or the like, the part which is articulately connected with the dipper arm and the dipper ladle link is provided with one or more connection and coupling means, such as hydraulic couplings of the female type. The accessory to be coupled to said part is provided with corresponding hydraulic couplings of the male type, such that the hydraulic couplings will be interconnected at the same time as the accessory, having been connected to one side of said part, is turned inwardly towards the other side to be attached thereto. The hydraulic couplings are kept together by the accessory having been connected with said part of the excavator. The device according to the invention is not dependent on hydraulic drive for the interconnection, and is usable also in connection with mechanical quick couplings.

DESCRIPTION OF THE PREFERRED EMBODIMENT

Figure 1:
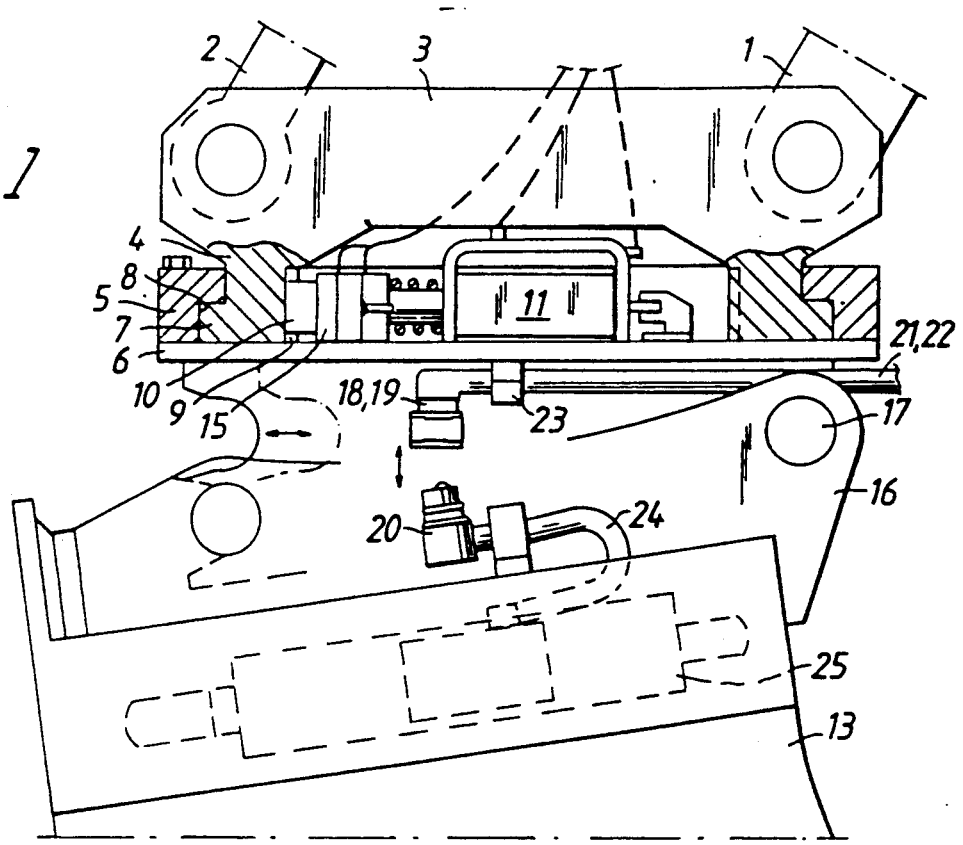
FIG. 1 is a side view, partly in cross section, showing an adjustable swivelling joint with hydraulic line connections being articulately connected with a dipper arm and the swivelling joint partly engaging an accessory.
Figure 2:
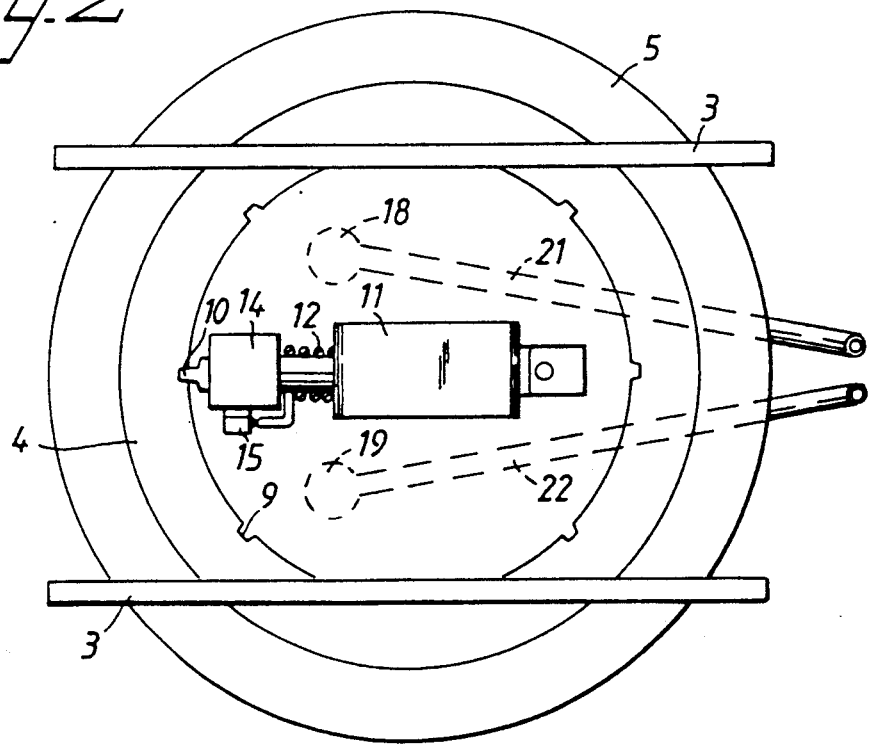
FIG. 2 is a top view of the adjustable swivelling joint with hydraulic lines.

FIGS. 1 and 2 show the structure of a joint with a coupling for hydraulic systems. By means of bearing structures, the dipper arm 1 and the dipper ladle link 2 of an excavator are articulately connected with a joint means of, for example, swivelling joint type with an upper part 3, which again is fixedly connected with an inner ring 4. The lower part of the swivelling joint substantially comprises an outer ring 5 and a base plate 6 fixedly connected therewith. A circular projecting edge 7 of the inner ring 4 is arranged to fit into a corresponding groove 8 in the outer ring 5. The inner ring 4 and the outer ring 5 thus form a swivelling joint and the base plate 6 prevents separation of the inner and outer rings.

Along the inner peripheral surface of the inner ring 4 there are provided a plurality of transverse grooves 9 arranged to cooperate with the cone-shaped wedge 10 or the like of a coupling device. The coupling device is connected with the base plate and may include a spring-balanced electro-magnet 11, wherein, in the deenergized state, the wedge is inserted in a groove by means of spring force and wherein, in the energized state, the electromagnet 11 counteracts the spring force so that the wedge 10 may be removed from the groove 9. On energizing, the compression spring 12 will thus be compressed and the inner ring 4 will be released from the coupling device connected with the base plate 6 and the outer ring 5, the inner ring and the outer ring being released from the locking jam and becoming turnable relative to each other for the setting of a desired operating position for the dipper ladle 13 relative to the dipper arm 1. The desired operating position may now be achieved by means of the different movements of the dipper arm and with the dipper ladle 13 resting on a firm underlayer, the electromagnet 11 being activated, in that the dipper arm 1 is operated such that the dipper ladle 13 is forced to turn into the desired position, and when this position has been reached, the current supply will be interrupted and the spring 12 released and the wedge 10 will be inserted by means of spring force in a suitable groove 9, the inner ring 4 having been fixed to the base plate 6 and the outer ring 5.

For correct centering of the cone-shaped locking wedge 10, it may be provided with a guiding sleeve 14 mounted between the inner ring 4 and the magnet 11. Further, there may be a need of sensing the position of the wedge 10 in order to be able to indicate whether the wedge 10 is completely inserted in the groove 9 of the inner ring 4. The position of the locking wedge 10 is sensed by means of a contact device 15 on the guiding sleeve, and the corresponding measuring signal is indicated in the excavator.

With this type of adjustable swivelling joint it is possible, from the driver's cab, to turn the dipper ladle a full turn relative to the dipper arm and to lock it in desired positions.

When an accessory, such as a dipper ladle 13, is to be coupled to a coupling part 3–6 of the dipper arm 1 of an excavator, the tranverse bolt 17 of the dipper ladle support 16 is first inserted in a fixed semi-circular recess in the coupling part (not shown in the figures) such that the recess will engage and lock the transverse bolt 17. The dipper arm will then be operated such that the coupling part 3–6 will be turned towards a second dipper ladle support and stop position, in which the final coupling and locking takes place automatically mechanically or hydraulically or is activated manually. On the underside 6 of the coupling part 3 oriented towards the accessory 13 there are one or more fixedly mounted hydraulic couplings 18, 19 of, for example, a female type. Further, on the accessory there are provided one or more hydraulic couplings 20 of a male type with the corresponding positional orientation, so that when the accessory 13 is coupled to the coupling part as described above, the hydraulic couplings 18–20 will be interconnected and hydraulic connections will be opened. When the accessory is disconnected and removed, the hydraulic connections will also be disconnected. This type of coupling is of simple construction, and since a large number of excavators are provided with mechanical quick couplings of accessories, the device according to the invention may be used for these types as well.

The hydraulic lines 21, 22 from the excavator, intended for the accessory concerned, end in female couplings 18, 19 and are attached to the underside 6 of the coupling part or the rotator by means of screw joints 23. The hydraulic lines 24 on the accessory to be connected to the coupling part end in a male coupling 20 and are secured to the upper part of the accessory. In order to compensate for the circular movement of the coupling on the accessory the male coupling 20 is somewhat flexible. The cone-shaped male portion is to be located such that on connection it will first touch the inner edge of the female coupling so that on full engagement it will be in the centre of the female portion. FIG. 1 shows the location in the accessory of a hydraulic cylinder 25 for the operation of some work function and its connection with the hydraulic line 24.

I claim:

1. The combination of an accessory for an excavator and a coupling device which is attachable to an arm of an excavator for connecting the accessory to the excavator, said accessory including a first support member which includes first and second mounting means and first hydraulic lines having first hydraulic coupling means, and said coupling device including a base element which includes third and fourth mounting means and second hydraulic lines having second hydraulic coupling means, means for immovably mounting said second hydraulic lines on said base element, said third and fourth mounting means of said coupling device being cooperable with said first and second mounting means of said accessory and said second hydraulic coupling means of said coupling device being cooperable with said first hydraulic coupling means of said accessory such that said first mounting means of said accessory can be pivotably connected to said third mounting means of said coupling device and thereafter said accessory can be pivoted about said third mounting means until said second mounting means becomes connected to said fourth mounting means, wherein said first hydraulic coupling means will become connected to said second hydraulic coupling means, thereby enabling drive fluid to be delivered from said coupling means to said accessory.

2. The combination as defined in claim 1, wherein said first hydraulic coupling means consist of female coupling elements and said second hydraulic coupling means consist of male coupling elements.

3. The combination as defined in claim 1, wherein said first hydraulic coupling means are flexible.

* * * * *